US010413137B2

(12) United States Patent
Wahl et al.

(10) Patent No.: US 10,413,137 B2
(45) Date of Patent: Sep. 17, 2019

(54) DESIGNER REFILLABLE WIPES CONTAINER

(71) Applicant: THE CLOROX COMPANY, Oakland, CA (US)

(72) Inventors: Stephen Don Wahl, San Francisco, CA (US); Benjamin Ma, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 15/064,876

(22) Filed: Mar. 9, 2016

(65) Prior Publication Data

US 2017/0258279 A1 Sep. 14, 2017

(51) Int. Cl.

| | |
|---|---|
| ***A47K 10/42*** | (2006.01) |
| ***B65D 43/16*** | (2006.01) |
| ***B65D 83/08*** | (2006.01) |
| ***B65D 85/62*** | (2006.01) |
| *A47K 10/32* | (2006.01) |

(52) U.S. Cl.

CPC ..... *A47K 10/422* (2013.01); *B65D 43/16* (2013.01); *B65D 83/0817* (2013.01); *B65D 85/62* (2013.01); *A47K 2010/3266* (2013.01)

(58) Field of Classification Search

CPC .. A47K 10/421; A47K 10/422; A47K 10/427; A47K 2010/3266; B65D 43/16; B65D 83/0811; B65D 83/0817; B65D 85/62

See application file for complete search history.

(56) References Cited

U.S. PATENT DOCUMENTS 2,085,649 A * 6/1937 Gluck ..... B65D 83/0847 206/449
2,287,420 A * 6/1942 Edmonston ..... B65D 83/0811 206/804
2,475,657 A * 7/1949 Braley ..... A47K 10/421 221/45

(Continued)

FOREIGN PATENT DOCUMENTS

WO 2009143535 A1 11/2009
WO 2011008839 A1 1/2011

(Continued)

*Primary Examiner* — Gene O Crawford
*Assistant Examiner* — Kelvin L Randall, Jr.
(74) *Attorney, Agent, or Firm* — Erin Collins

(57) ABSTRACT

Dispensing containers including a bottom, a top, and one or more side walls defining an interior cavity within the container. A support structure adjacent the bottom of the container forms an angle between a top surface of the support structure and the bottom that is from 120° to 150°. This allows the container to accommodate a rectangular stack of wipes positioned within the interior cavity of the container, in a substantially vertical orientation, with the short side contacting the bottom of the container, and the underside of the stack contacting the top surface of the support structure. The stack of wipes may be taller than the height of the container, fitting into the container due to the slightly angled orientation of the stack, the flexible nature of the stack of wipes, and the support structure allowing the stack to bend or flop over the support.

15 Claims, 13 Drawing Sheets

(56) References Cited

U.S. PATENT DOCUMENTS 3,243,079 A * 3/1966 Rettmer ..... B65D 83/0811 221/63
3,265,241 A * 8/1966 McColgan ..... A47K 10/421 221/47
3,381,853 A * 5/1968 Ferris ..... B65D 81/36 221/63
3,395,830 A * 8/1968 Buttery ..... B65D 5/16 221/63
3,624,791 A * 11/1971 Taub ..... A47K 10/421 221/59
3,881,632 A * 5/1975 Early ..... B65D 83/0811 221/50
4,231,491 A * 11/1980 Pierson ..... A47K 10/421 221/48
4,714,643 A * 12/1987 Kuenzel ..... B65D 83/0811 206/233
5,979,699 A * 11/1999 Simpson ..... A47K 10/422 221/52
6,915,923 B1 * 7/2005 Magid ..... B65H 1/08 221/56
D611,282 S 3/2010 Gehring
D623,451 S 9/2010 Gehring
D630,939 S 1/2011 Peters et al.
D638,643 S 5/2011 Gehring
8,261,938 B2 * 9/2012 Oradini, Sr. ..... B65D 83/08 221/33
D696,966 S 1/2014 Finlay
2003/0168468 A1 * 9/2003 Thompson ..... B42D 5/005 221/56
2004/0155051 A1 * 8/2004 Magid ..... B65D 83/12 221/59
2004/0164086 A1 * 8/2004 Thompson ..... B65D 83/0817 221/56
2004/0211788 A1 * 10/2004 Simpson ..... A47F 1/12 221/61
2005/0000976 A1 * 1/2005 Keberlein ..... B65D 5/2042 221/63
2007/0262086 A1 * 11/2007 Cook ..... B65D 5/001 221/305
2008/0054012 A1 * 3/2008 Long ..... A47K 10/421 221/63
2011/0297694 A1 * 12/2011 Conway ..... A47K 10/421 221/46
2012/0097697 A1 4/2012 Gehring
2013/0153597 A1 * 6/2013 Hill ..... A47K 10/42 221/45
2014/0209625 A1 7/2014 White

FOREIGN PATENT DOCUMENTS

WO 2014097078 A1 6/2014
WO 2014116471 A2 7/2014

* cited by examiner

DESIGNER REFILLABLE WIPES CONTAINER

CROSS-REFERENCE TO RELATED APPLICATIONS

N/A.

BACKGROUND OF THE INVENTION

1. The Field of the Invention

The present invention is generally related to pop-up dispensing systems for wipes, for example, to dispensing systems containing a rectangular stack of wipes, which allow dispensing one wipe at a time from the container.

2. Description of Related Art

Cleaning wipes are readily available and well known in the art. Such wipes are often housed within a container, allowing the consumer to dispense a wipe when desired for use. Existing dispensing containers though are not particularly well suited to the desired aesthetics of a kitchen, bathroom, or other typical consumer room where they may be employed, so that consumers will typically store such containers of wipes within a cupboard or drawer, rather than on a tabletop or countertop, where easier access would be possible. As such, while various dispensing devices exist, there remains a continuing need for improved devices.

BRIEF SUMMARY

One aspect of the present invention relates to a dispensing container including a container that may include a bottom, a top, and one or more side walls defining an interior cavity within the container. A support structure is provided within the interior cavity which is adjacent to the bottom of the container, and which forms an initial angle with the bottom of the container that is greater than 90°. At least a portion of the support structure (e.g., the supporting top surface thereof) forms an angle with the bottom of the container that is from 120° to 150°. For example, the initial angle formed by the supporting top surface of the support structure relative to the bottom of the container, or an angle formed further up the supporting top surface of the support structure relative to the bottom (i.e., floor) may be from about 120° to about 150°. A rectangular stack of wipes (i.e., having a short side and a long side) may be positioned within the interior cavity of the container, in contact with the support structure so that the stack has an angled, substantially vertical orientation within the container. The stack of wipes may be taller than the height of the container, so as to only fit into the container due to the slightly angled orientation of the stack, in combination with the flexible nature of the stack of wipes, coupled with the support structure allowing the stack to bend or flop over the support, allowing the long stack of wipes to fit within the container, as it rests against the support structure.

Another aspect of the invention relates to a container (e.g., including a bottom, top, and one or more side walls defining an interior cavity), a convex support structure in the interior cavity, which is adjacent the bottom of the container, and which forms an angle with the bottom of the container that is from about 120° to about 150°. The angle provided between the bottom and the supporting top surface of the support structure may vary along the arc length of the convexly curved top surface, so that the initial angle may be greater than 90°, and somewhere within a mid-portion thereof the angle may be from about 120° to about 150°. In some embodiments, the terminating angle at the highest point along the top surface of the support structure may form a terminating angle relative to the bottom that is from about 140° to about 170°. A rectangular stack of wipes may be positioned within the interior cavity so that a short side of the stack of wipes contacts the bottom of the container, and the stack of wipes is supported against the top surface of the support structure. The angled orientation of the stack, and its flexible nature allows a stack of wipes that is taller than the container to be accommodated therein.

The described containers may be of variously defined shapes. For example, in an embodiment, the container may be generally rectangular (e.g., with 4 side walls). In another embodiment, the container may be cylindrical. A cylindrical container may include a bottom, a top, and a side wall defining an interior cavity, and a support structure in the interior cavity which is adjacent to the bottom of the container. The support structure (e.g., the supporting top surface thereof) forms an angle with the bottom of the container that is from about 120° to about 150°. The angle formed with the bottom may vary along the length of the supporting top surface, e.g., increasing from a location adjacent the base towards the highest point along the top surface of the support structure. The container may include a dispensing orifice beneath a lid associated with the top of the container, which forms an angle that is from about 120° to about 150° relative to the bottom. A rectangular stack of wipes having a short side and a long side may be provided in the interior cavity of the container, positioned so that the short side of the stack contacts the bottom of the container, with the stack being supported by the top surface of the support structure.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
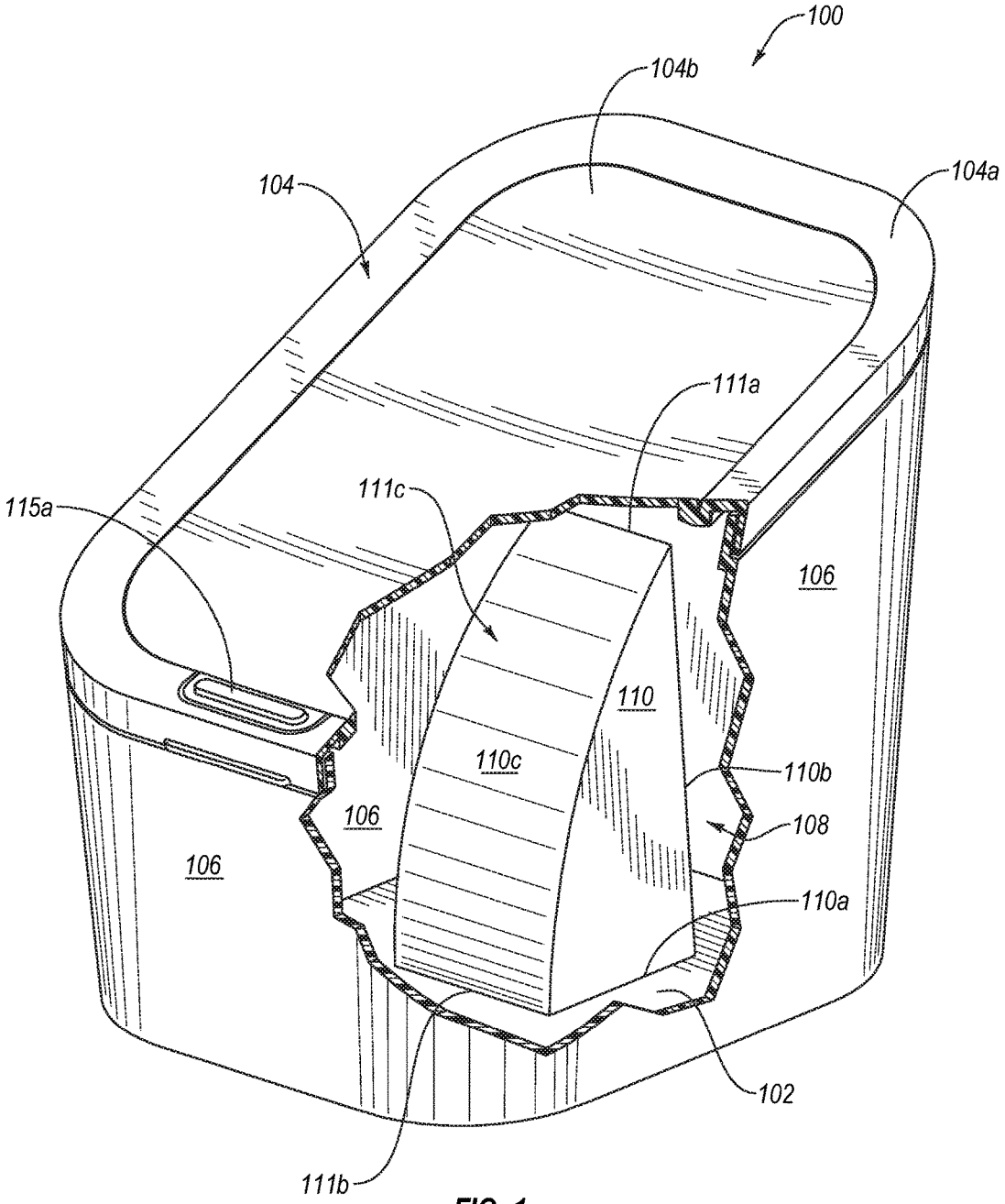
FIG. 1 is a cut-away perspective view of an exemplary dispensing container according to the present invention, without any wipes in the container.
Figure 2:
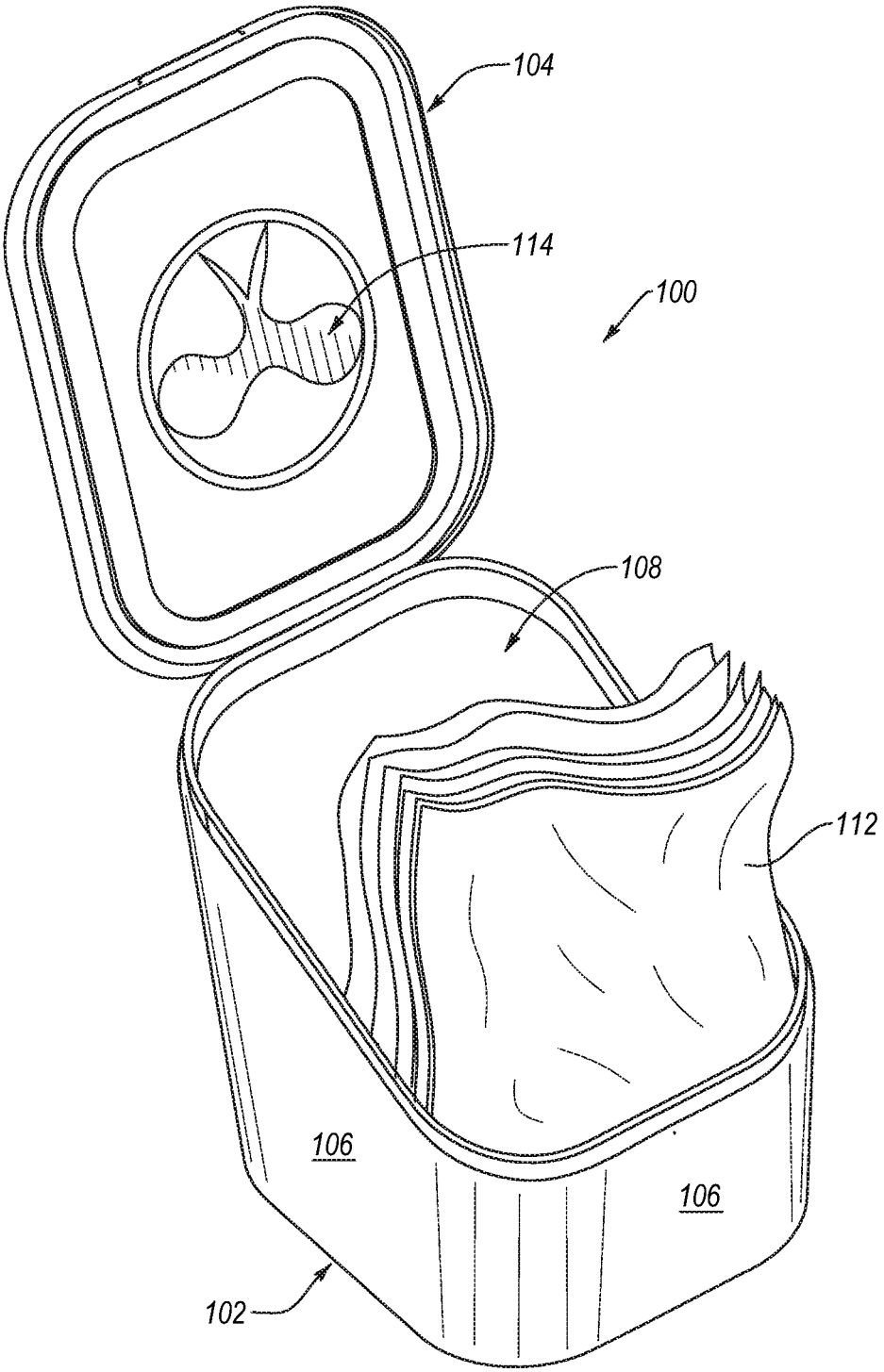
FIG. 2 is a perspective view of the dispensing container of FIG. 1, with the lid opened, and a stack of wipes positioned in the front end of the container, standing generally vertically.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element or step not specified in the claim.

As used in this specification and the appended claims, the singular forms "a," "an" and "the" include plural referents unless the content clearly dictates otherwise. Thus, for example, reference to a "surfactant" includes one, two or more surfactants.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of a composition.

As used herein, the terms "nonwoven" or "nonwoven web" means a web having a structure of individual fibers or threads which are interlaid, but not in an identifiable manner as in a knitted web. Nonwoven webs may be formed from many processes, such as, for example, meltblowing processes, spunbonding processes, spunlace processes, airlaid processes and bonded carded web processes. The particular method for fiber lay down for layers of a nonwoven wipe is not particularly limited.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In an aspect, the present invention is directed to "designer" wipes dispensing containers. Such containers are more readily accepted for long term placement on a table or countertop, rather than being relegated to placement in a closed or hidden location (such as a drawer or cupboard). According to an embodiment, such a container may include a bottom, top, and one or more side walls defining an interior cavity. The container is configured to accommodate a rectangular stack of wipes. Such a stack of wipes may have a short side (the width), and a long side (the length). The stack may also have a thickness, which depends on how many wipes are included in the stack. A typical stack may include about 20 to about 100, about 25 to about 80, or about 30 to about 50 wipes. For example, such a stack may be about 0.5 inch (about 12.7 mm) to about 1.25 inch (about 31.75 mm), or about 1 inch (about 25.4 mm) thick. The wipes may have various desired width and length dimensions, e.g., about 7 inches (177.8 mm) by about 8 inches (203.2 mm). The wipes may be folded, to decrease the width and/or length dimension. For example, a typical folding pattern may result in a folded wipe having a length of 7 inches (177.8 mm) and a width of about 4 inches (101.6 mm). It will be apparent that various sizes, folding patterns, etc. may be employed, as desired.

The length of the stack of wipes may actually be greater than the height of the interior cavity of the container, although the stack of wipes may still be accommodated within the interior cavity as will be described herein. The container may further include a support structure in the interior cavity, which support structure is adjacent the bottom of the container (e.g., it may contact the container bottom). In an embodiment, a top surface of the support structure may form an angle relative to the bottom of the container. Such angle may be in a range from about 120° to about 150°.

The support structure may include a supporting top surface that is curved, or angled. For example, the top surface of the support structure may be convexly curved. The support structure serves as a support against which the rectangular stack of wipes may lean. Because of the flexible, bendable nature of the rectangular stack of wipes, the stack of wipes may bend so as to follow at least a portion of the contour of the top surface of the support structure. In an embodiment, the support structure may have a height that terminates short of the top of the interior cavity, and the stack of wipes may "flop" or bend over the rear end of the top surface of the support structure. As a result of this bent or "flopped-over" orientation assumed by the stack of wipes, the relatively tall stack of wipes may be accommodated within the interior cavity of the container.

III. Exemplary Dispensing Containers

FIGS. 1-5 show an exemplary dispensing container 100. Container 100 is shown as being generally rectangular in cross-sectional shape, and including a bottom 102, a top 104, and sidewalls 106. An interior cavity 108 is defined between the various top, bottom, and side walls. A support structure 110 is shown positioned within the interior cavity 108, adjacent the bottom wall 102 of container 100. Support structure 110 is shown as being of a wedge shape, having a bottom surface 110*a* (e.g., positioned against the bottom wall 102), a side surface 110*b*, which is shown as being substantially vertical relative to bottom wall 102, and a top surface 110*c*. As shown, the bottom and side surfaces 110*a* and 110*b* may be perpendicular to one another, with top surface 110*c* forming a hypotenuse between the bottom and side surfaces 110*a* and 110*b*. As shown, top surface 110*c* may be convexly curved, rather than simply arranged at a flat, straight angle extending between the front end of bottom surface 110*a* and the top end of side surface 110*b*. Although curvature may be preferred, some embodiments may include a flat, straight angled top surface.

Figure 4:
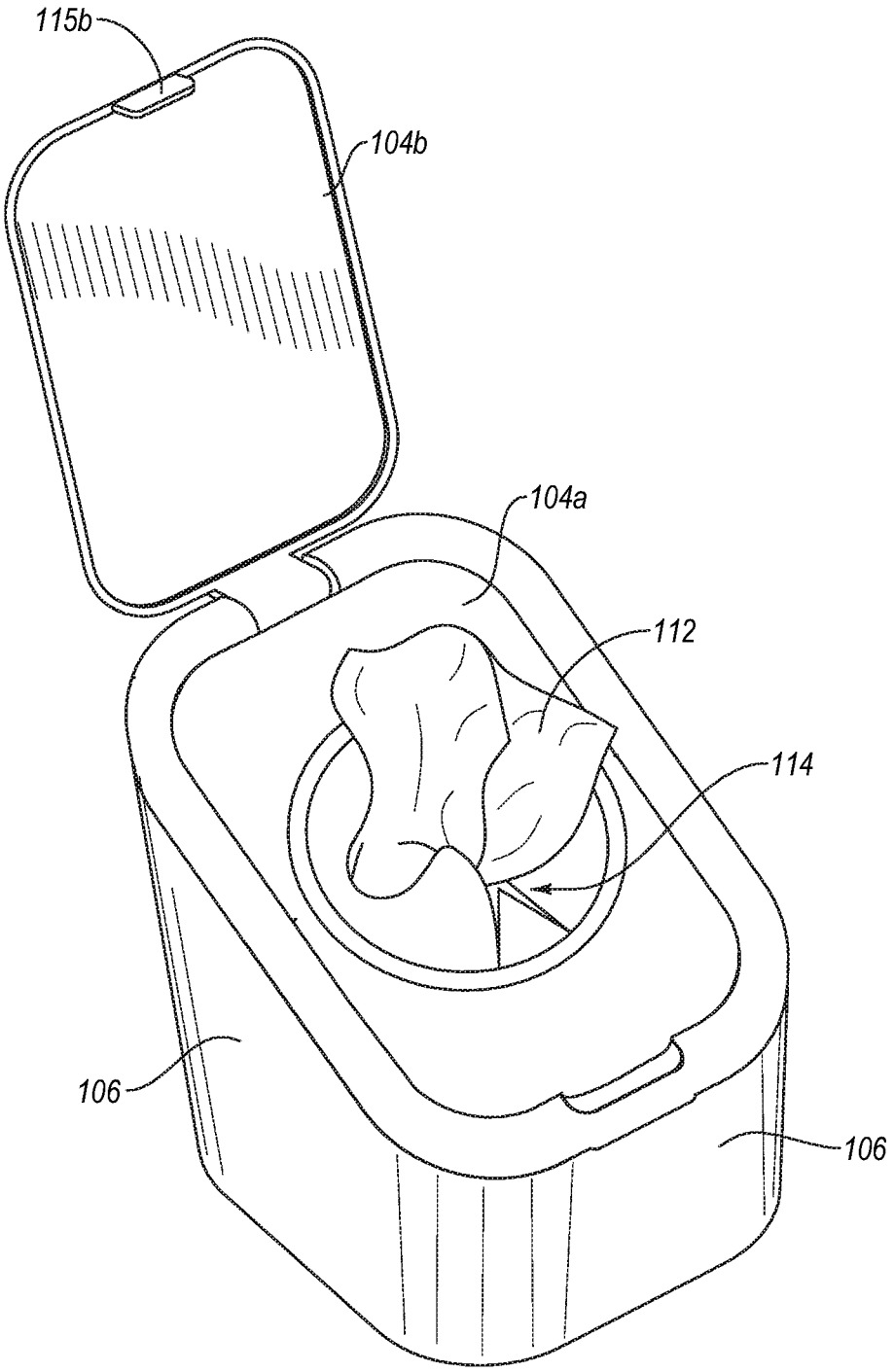
FIG. 4 is a perspective view of the dispensing container of FIG. 2, with the lid portion of the top including an orifice closed over the sidewalls of the container body, and single wipe from the stack of wipes threaded through the orifice of the lid, with the other lid portion that selectively closes over the orifice shown opened.
Figure 5:
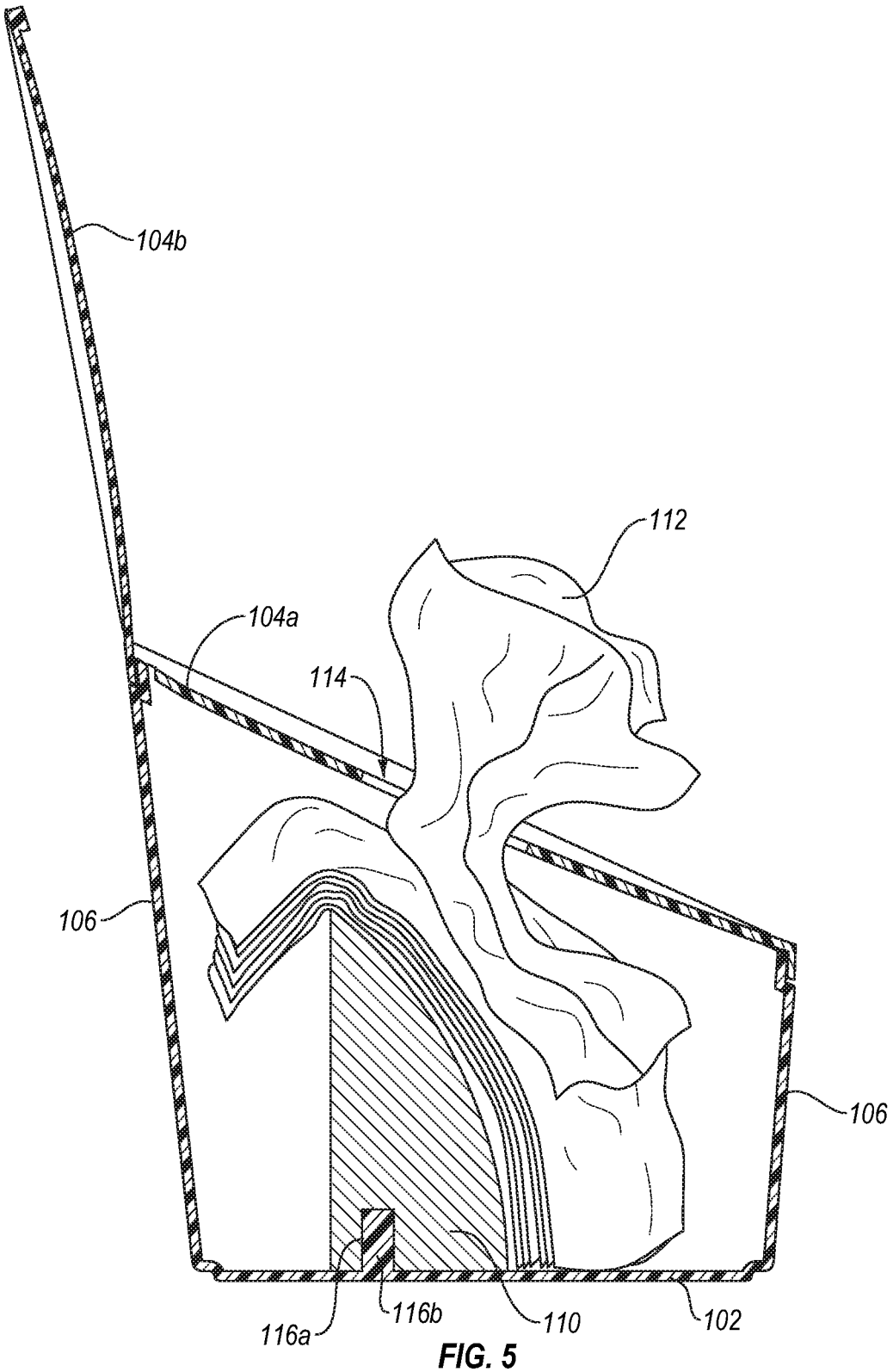
FIG. 5 is a cross-sectional schematic view through the container of FIG. 4, showing how the rectangular stack of wipes bends or flops over the support structure within the container.
Figure 5A:
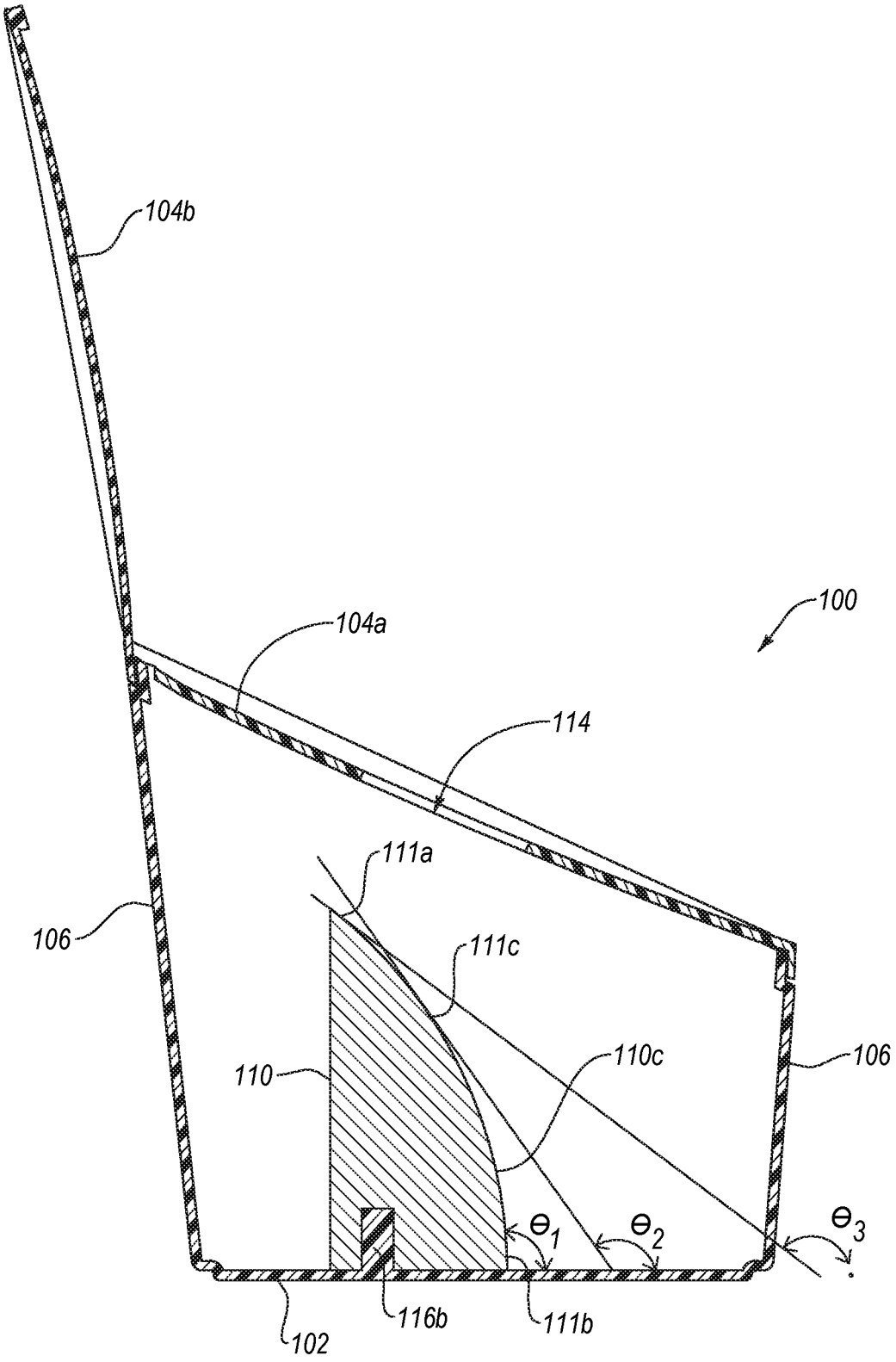
FIG. 5A is a cross-sectional view similar to FIG. 5, but without the stack of wipes shown, illustrating various angles formed between the supporting top surface of the support member and the bottom of the container.

The top surface 110*c* of the support structure may form an initial angle $\theta_1$ that is greater than 90°. Because of the backward, convex curvature of the top surface 110*c*, the angle formed between the bottom and the supporting top surface 110*c* (or a line tangent thereto) varies along the arc length of top surface 110*c*. FIG. 5A illustrates several such various angles. For example, initial angle $\theta_1$, (at 111*b*) may be greater than 90°. Part way up the top surface 110*c* (e.g., at 111*c*), the angle $\theta_2$ may be from about 120° to about 150°. Where top surface 110*c* terminates (e.g., at 111*a*), the angle may be greater than at 111*c*, e.g., it may be from about 140° to about 170°. The stack of wipes 112 may often lean against at least the mid-section of the support structure 110, and a major portion of the stack may assume an angulation that is also roughly 120° to 150° relative to bottom 102. For example, this may be roughly the angulation assumed by that portion of the stack of wipes that is positioned forward or over the support structure 110, while the remaining portion of the stack of wipes, that may be positioned behind the support, may bend or flop downward, towards bottom wall 102. Such a representation is shown in FIG. 5. The top surface 110 may thus provide a backwardly slopped, curved surface against which a stack of wipes 112 may be positioned. The angles of the stack of wipes described above may be characterized as "substantially vertical", in that the orientation of the stack may be closer to vertical (180°) than horizontal (0°). The stack of wipes 112 is not shown in FIGS. 1 and 5A in order to better show the various surfaces of the support structure 110, while the stack of wipes 112 is shown in FIGS. 2-5.

As mentioned, where the top surface 110 is convexly curved, it will be apparent that the angle formed relative to bottom wall 102 by top surface 110 may increase from the bottom front corner 111*b* to the top rear corner 111*a*. For example, the initial angle $\theta_1$ between bottom wall 102 and top surface 110 at 111*b* may be somewhat more than 90° (e.g., greater than 90° to about 95°), and may increase as the location progresses up the wedge shaped support structure 110, so as to be from 120° to 150° at location 111*c*, within a mid-section of top surface 110. Such a curved top surface may, in some embodiments, cause the stack of wipes 112 to also assume a curved orientation, aiding to fit the length of the stack of wipes into the container, as such a curve includes a longer arc length than a straight line between any two given points would provide.

In an embodiment, both the bottom surface 110*a* and side surface 110*b* may be flat. The bottom surface 110*a* may be shorter in length than the side surface 110*b*. For example, the bottom surface may be about 40 mm in length (e.g., from about 30 to about 50 mm). The side surface 110*b* may extend to a height that is about half or more of the height of the container 100. For example, the side surface may be about 80 mm in height (e.g., about 70 to about 90 mm), while the height of the container at a location aligned with the side surface 110*b* may be about 120 to about 150 mm. The front of the container 100 may be about 105 mm in height (e.g., about 95 mm to about 115 mm), while the back of the container 100 may be about 140 mm in height (e.g., about 130 mm to about 150 mm). Such dimensions are merely exemplary. Various sizes are of course possible. It will be apparent that in one such embodiment, the stack of wipes (e.g., 7 inches in height) may thus be taller than at least the front of the cylindrical container 200, only fitting therein because of the bent over, flopped, or draped configuration assumed by the stack of wipes within the container.

As will be apparent from FIGS. 1 and 5A, the support structure 110 may have a radius of curvature relative to top surface 110*c* that is not constant, but which varies depending on location. For example, as will be apparent from the bottom surface 110*a* being shorter than side surface 110*b*, the radius of curvature of connecting top surface 110*c* may be tighter adjacent front bottom edge 111*b*, as compared to rear top edge 111*a*. Furthermore, the width of top surface 110*c* (from one side to the other, such as left to right) may vary from top to bottom. Such tapering is shown in FIG. 1. For example, the top surface 110*c* may be of a greater width at 111*b*, from one side to the other, as compared to the width of top surface 110*c* at 111*a*, from one side to the other. In other words, the width of the top surface 110 may taper so as to be narrower at 111*a* than 111*b*. Such taper may increase the stability of the support structure 110. By way of example, the top surface width at 111*a* may be about 5% to about 25%, or 10% to 20% narrower than the top surface width at 111*b*. It will be apparent that the support structure may have a width that is less than that of the stack of wipes it supports. For example, the average width of the top surface of the support structure may be less than 50%, less than 45%, or less than 40% that of the stack of wipes. For example, the stack may measure about 4 inches in width, while the top surface of the support structure may range from less than 2 inches (e.g., about 1.75 inches) at 111*b* to about 1.5 inches at 111*a*.

The container may be configured to provide for dispensing of the wipes 112 through the top 104 of the container 100. As shown, the top 104 of container 100 may be angled downward, sloping downward towards the front. In other words, the rear sidewall 106 may have a height that is greater than the front sidewall. By way of example, the top 104 may form an angle relative to the bottom wall 102 that ranges from about 120° to about 150°. Such a sloping configuration to the top wall aids with accessing a single wipe of the stack of wipes that is threaded through an orifice associated with the top of the container as seen in FIG. 4. As described above, this slope of the top 104 may be approximately equal to the orientation assumed by a substantial length of stack of wipes, so that at least a central portion of the stack of wipes may be generally parallel with the lid 104. Such generally parallel orientation may facilitate easier dispensing of the wipes.

Figure 3:
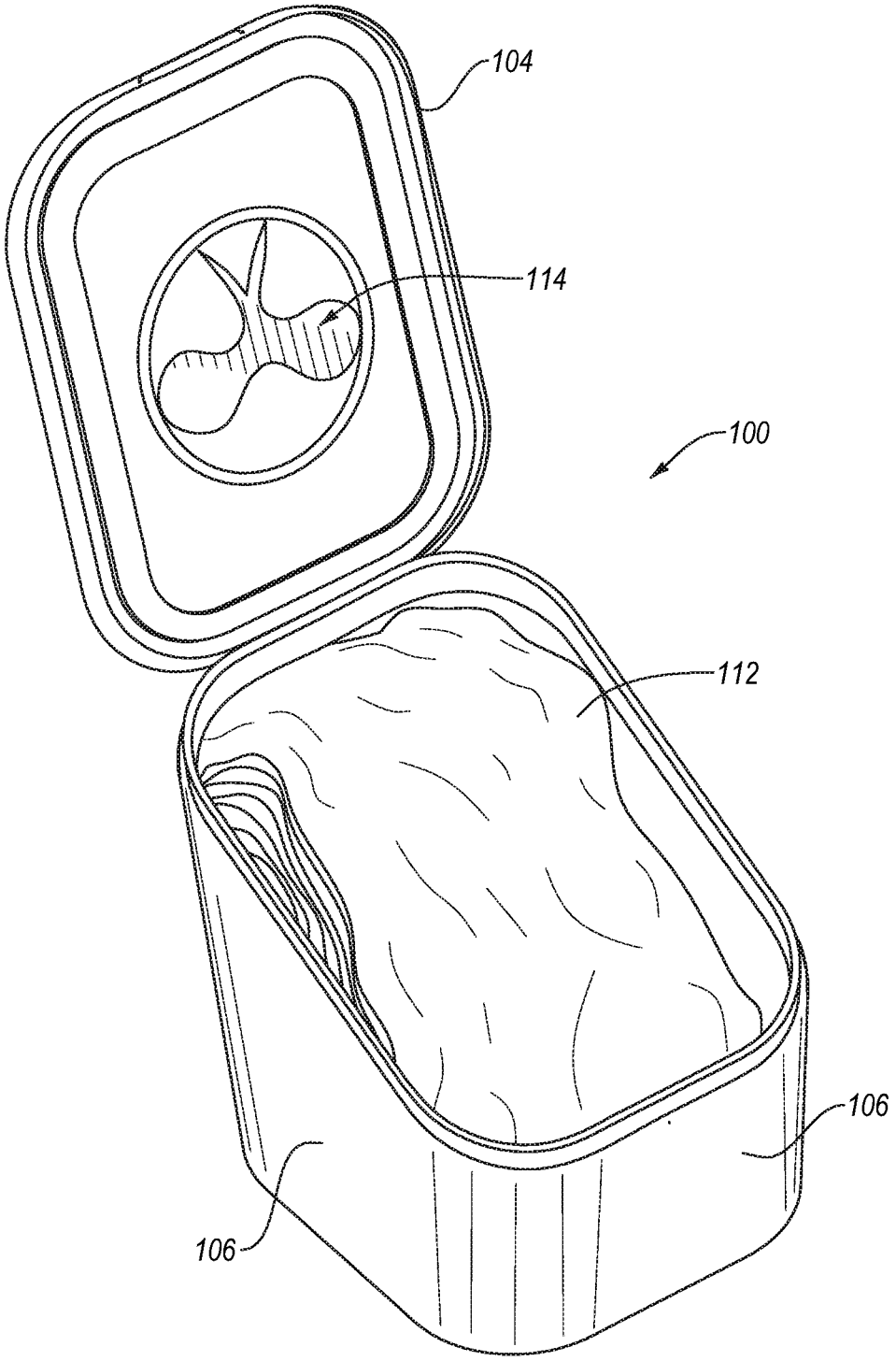
FIG. 3 is a perspective view of the dispensing container of FIG. 2 with the stack of wipes tipped over, so that the stack of wipes bend or flop over the support structure within the container.

FIG. 3 shows such a configuration in which a substantial length of the stack of wipes 112 is oriented to be generally parallel with the top, and dispensing orifice 114. In other words, in some embodiments, the support structure 110 may be configured to cause the a substantial length of the stack of wipes 112 to assume a position and orientation within container 100 that is substantially parallel to the top 104 of the container 100 (when top 104 is closed, as in FIG. 1 or 4). For example, where the stack of wipes is so oriented, a substantial length of the stack of wipes may be situated to be within about 20°, about 15°, about 10°, or within about 5° of the plane defined by the top 104.

According to an embodiment, as seen in FIGS. 2-5, the top 104 may include two portions, 104*a*, and 104*b*, which can close over the container 100. Lower portion 104*a* may include the orifice 114 therein, while otherwise largely closing off otherwise open top end of the container 100. Portion 104*b* may serve as a lid that selectively closes over lower portion 104*a*, covering the orifice 114, and any wipe that may be threaded through orifice 114. One or more latch mechanisms may be provided at the front end of container 100 (e.g., at the front of lower portion 104*a* and/or upper portion 104*b*), allowing a user to selectively open and close lid portion 104*a* to insert a stack of wipes, and to selectively open and close lid portion 104*b* over orifice 114, to access a wipe 112 threaded through orifice 114, when one is desired. For example, a latch 115*a* may be provided for latching lid portion 104*a* to the front sidewall 106. Another latch 115*b* may be provided for latching lid portion 104*b* to lid portion 104*a*. Various suitable latching mechanisms will be apparent to those of skill in the art. When the container is not actively being used to dispense, the lid portion 104*b* may be closed, as reflected in FIG. 1. The lid (e.g., lid portion 104*a* and 104*b* together) may provide a sufficiently air-tight seal to prevent pre-dosed wipes 112 stored therein from drying out prior to use. For example, such seal characteristics may be sufficient to prevent dry-out of wipes for at least 1 month, or longer.

As shown, dispensing orifice 114 may be provided in top 104, e.g., in lower top portion 104*a*, beneath top portion 104*b*, which selectively covers orifice 114. Where top portion 104*a* is angled relative to bottom 102, the orifice 114 may similarly be angled relative to the bottom 102. For example, dispensing orifice 114 may be in a plane forming an angle from about 120° to about 150° relative to the bottom 102 of container 100. In other words, the dispensing orifice may be substantially parallel with the top of the container. As described above, where a substantial length (e.g., particularly the central portion) of the stack of wipes is also in this angled orientation, the stack 112, the orifice 114, and the top 104 may all be generally parallel with one another. The orifice 114 may be disposed over, parallel to, and/or aligned with the support structure 110.

Figure 6:
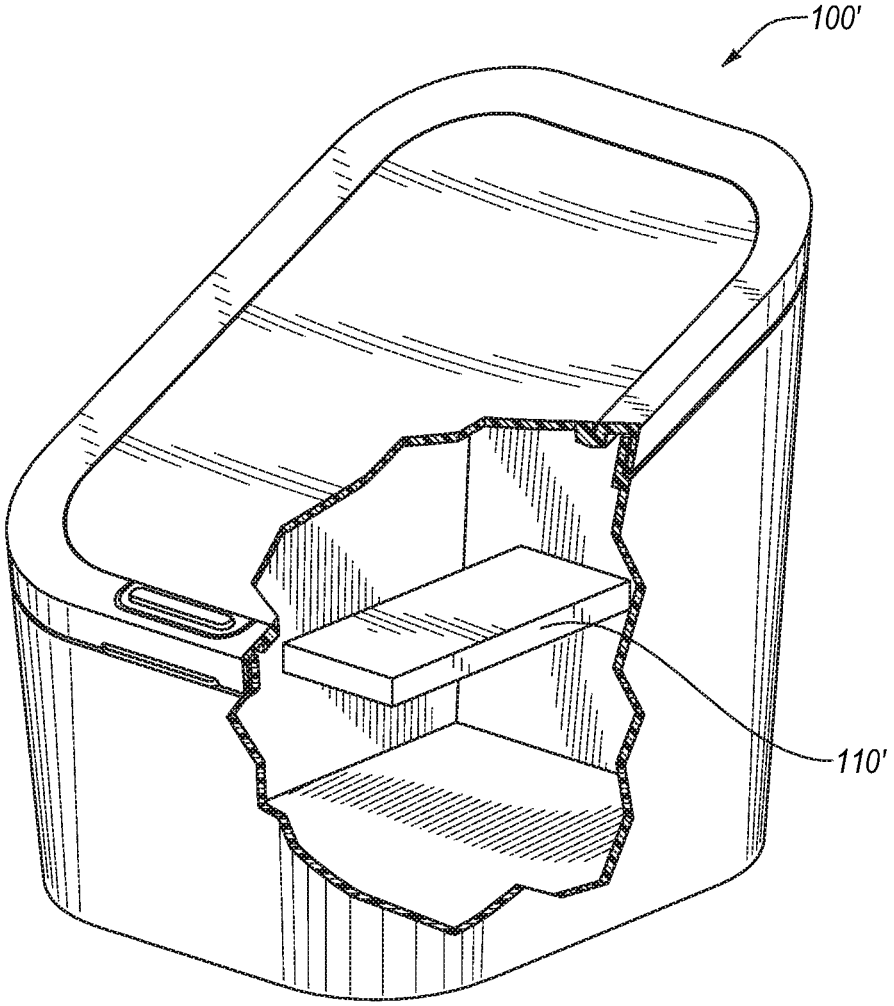
FIG. 6 shows an alternative container similar to that of FIG. 1, but in which the support structure is attached to the rear sidewall of the container.

As shown in FIG. 5, the support structure 110 may include a recess 116*a* formed therein, while the bottom wall 102 may include a corresponding projection 116*b*, which is received into the recess 116*a* in the support structure 110, attaching the two together. The support structure 110 may be fixed in place (e.g., glued between 116*a* and 116*b*), or may be removable, as desired. While illustrated as attached to the bottom wall 102, it will be appreciated that the support structure 110 could also or alternatively be attached to the sidewall 106. For example, the rearward length of the support structure 110 could simply be extended (not shown) to reach the rear sidewall 106. In another embodiment, an alternative support structure could be attached to the sidewall, and not the bottom 102. For example, FIG. 6 illustrates a support structure 110' attached to the sidewall 106 of container 100. A recess and projection such as 116*a* and 116*b* could be used to attach a support structure 110' to a sidewall 106 similar to as shown for the attachment to the bottom wall 102. Additional drawings and description of exemplary rectangular containers can be found in U.S. Design patent application Ser. No. 29/519,394, filed Mar. 4, 2015, herein incorporated by reference in its entirety.

FIGS. 7-10 illustrate another exemplary container 100 according to the present invention. Container 200 is shown as being generally cylindrical in shape. Of course, container shapes other than generally rectangular (as seen in FIGS. 1-6) and generally cylindrical are also possible. Container 200 is shown as including a bottom 202, a top 204, and a sidewall 206. FIG. 1 shows a cut away into the interior cavity 208 of container 200, showing the support structure 210 positioned therein. Support structure 210 is shown as positioned adjacent bottom 202 of container 200, and includes a top surface 210*c*, as well as bottom and side surfaces 210*a* and 210*b*, similar to support structure 110. An angle may be formed between bottom 202 and the top surface 210 (e.g., somewhere in the mid-section between 211*b* and 211*a*) that is from 120° to 150°, similar to as shown with container 100 is FIG. 5A. A stack of wipes 212 may be supported against support structure 210 in a similar manner as stack 112 is supported by support structure 110, described above.

A dispensing orifice 214 may be provided within the top 204 of container 200, e.g., beneath the lid portion 204*b*, which closes over orifice 214. As shown, the dispensing orifice may be recessed into a top container portion 200*b*, below the top of portion 200*b*, where the container body may include separate portions (a lower portion 200*a*, and an upper portion 200*b*). The dispensing orifice 214 may be angled relative to bottom 202. For example, similar to container 100, orifice 214 may be in a plane that forms an angle that is from about 120° to about 150° relative to bottom 202. Stack of wipes 212 may be disposed within interior cavity 208 so that the short side of the rectangular stack of wipes contacts the bottom 202 of container 200.

Figure 7:
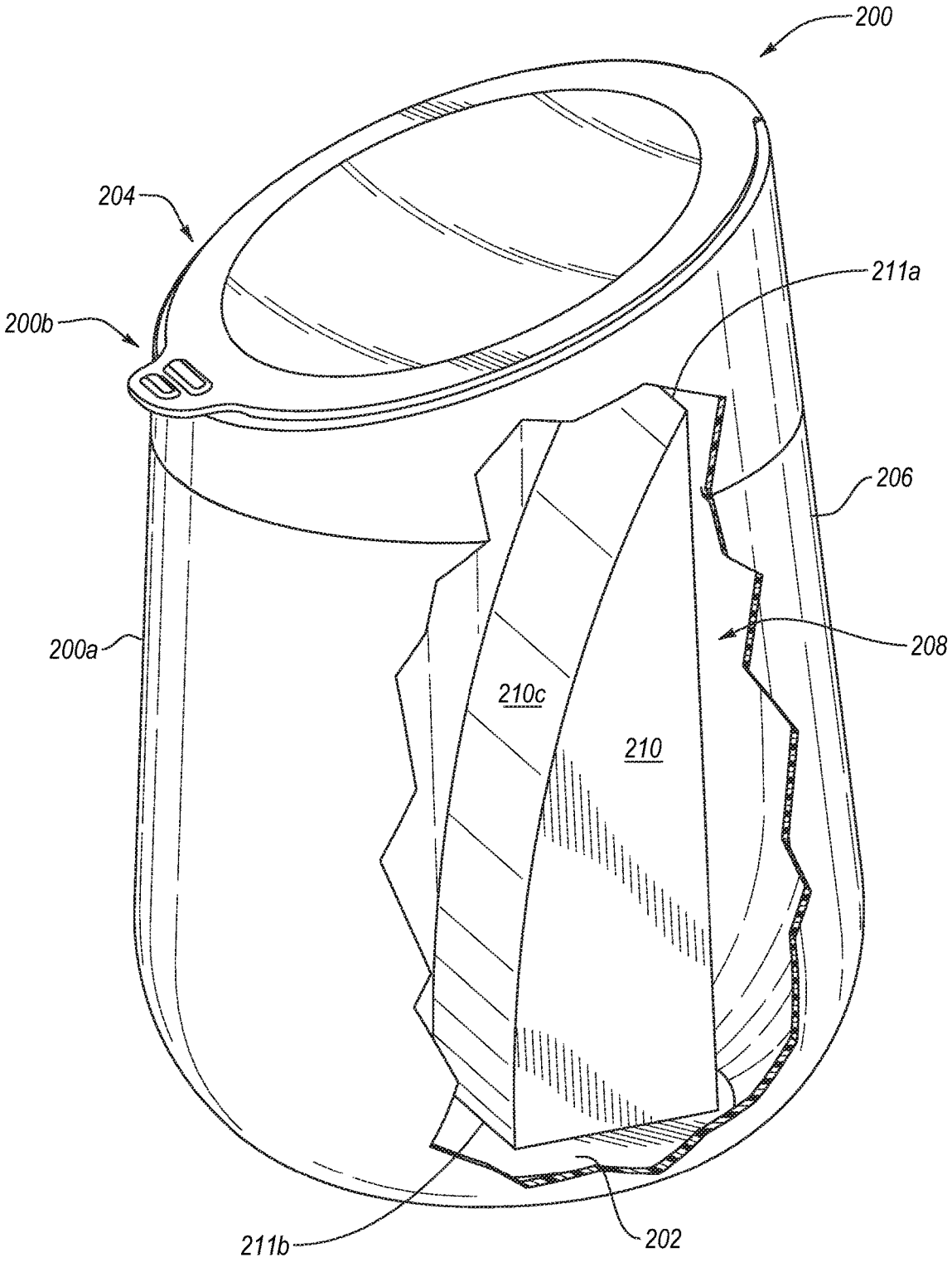
FIG. 7 is a cut-away perspective view of another exemplary dispensing container according to the present invention, without any wipes in the container.
Figure 8:
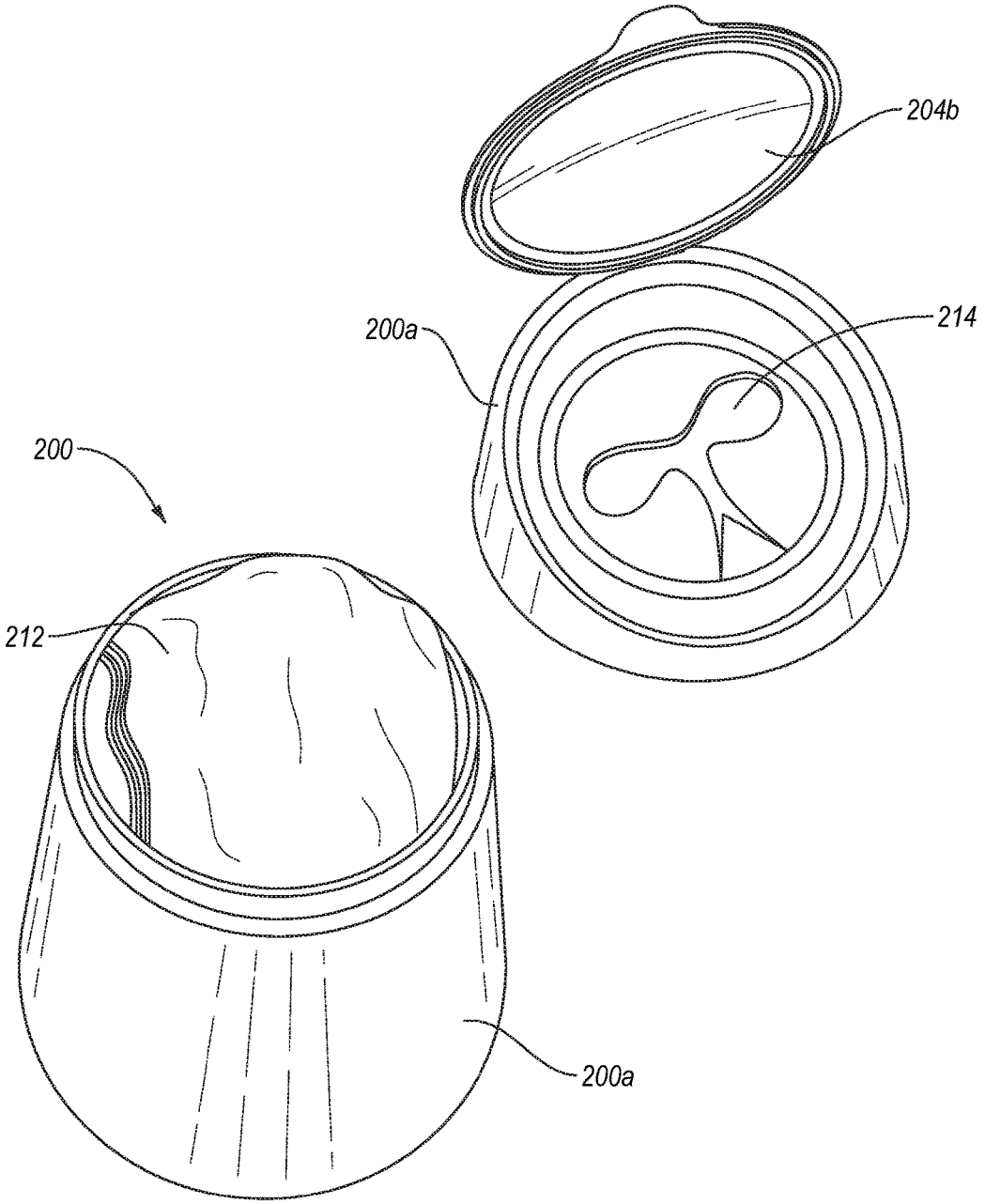
FIG. 8 is a perspective view of the dispensing container of FIG. 7, with a top portion of the container including the lid removed, and a rectangular stack of wipes positioned within the container.

As seen in FIGS. 7-8, the container body itself may be provided in two pieces (e.g., a lower portion 200*a* and an upper portion 200*b*), which portions can be coupled together (e.g., using mating slots and grooves). Such a configuration allows a user to remove the top portion 200*b* (which may include orifice 214 and lid portion 204*b*), providing a larger opening into which the rectangular stack of wipes 212 may be inserted. FIG. 8 shows the top portion 200*b* removed from the lower portion 200*a*, and a rectangular stack of wipes 212 having been inserted into the lower portion 200*a*, supported against the support structure 210. Stack of wipes 212 may have similar size characteristics as described above relative to stack 112.

Figure 9:
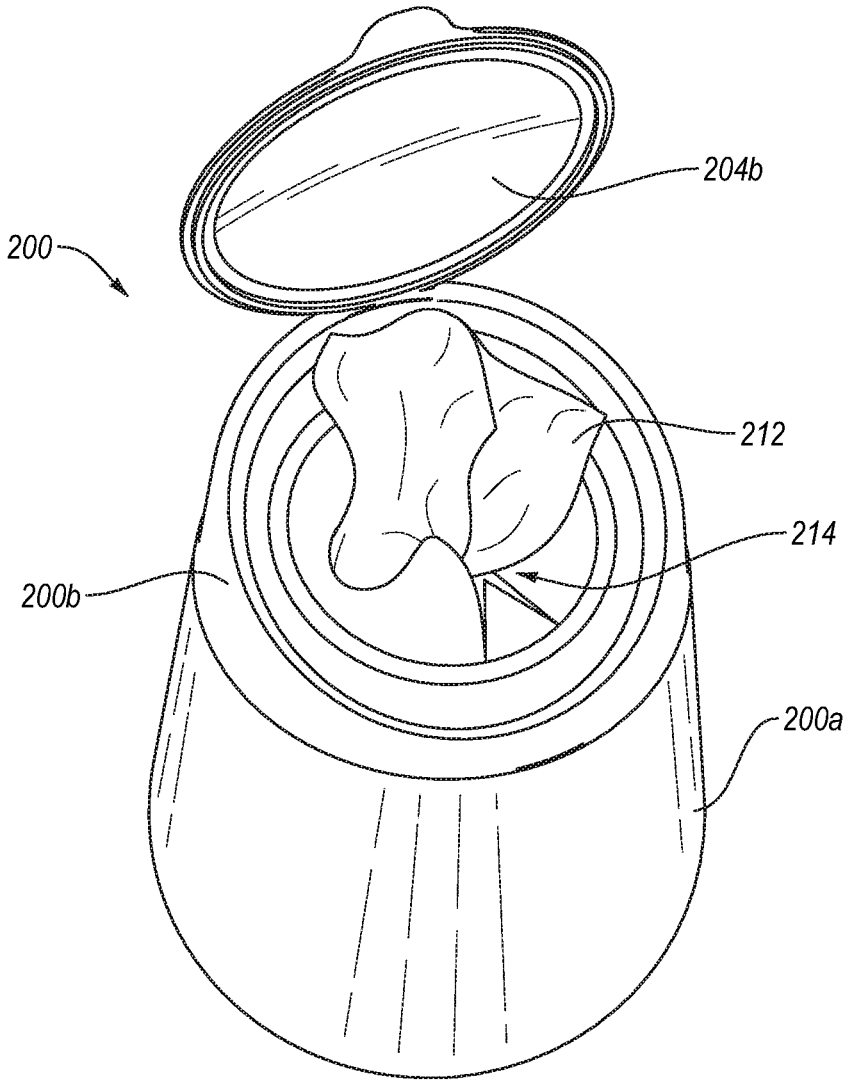
FIG. 9 is a perspective view of the dispensing container of FIG. 8, with the top portion of the container coupled over the top of the bottom portion of the container, and a single wipe from the stack of wipes threaded through the orifice of the top portion, with a lid portion shown opened.
Figure 10:
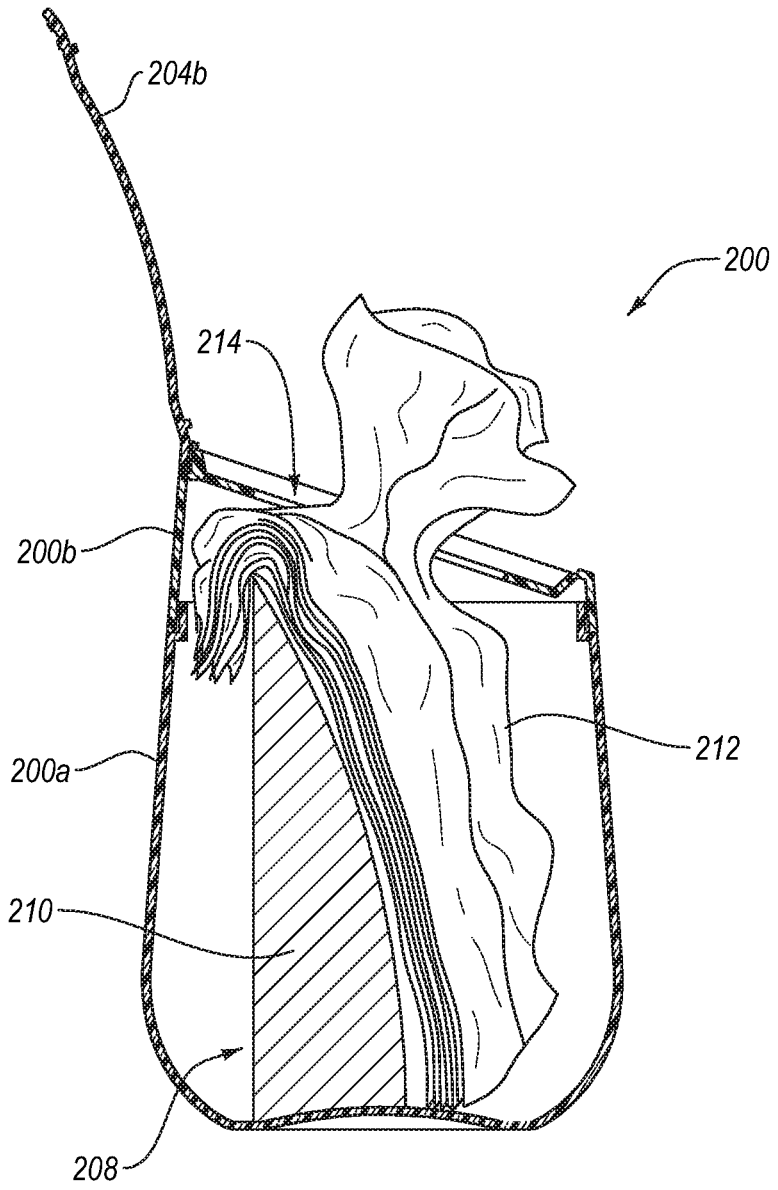
FIG. 10 is a cross-sectional schematic view through the container of FIG. 9, showing how the rectangular stack of wipes bends or flops over the support structure within the container.

FIG. 9 shows the upper portion 200*b* having been coupled over the lower portion 200*a*, and the wipe at the top of stack 212 having been threaded through orifice 214, for dispensing. In FIG. 9, the lid 204*b* of upper portion 200*b* is shown opened. It will be appreciated that it may be closed over orifice 214, as seen in FIG. 7, providing a substantially air-tight seal to prevent the wipes within container 200 from drying out. FIG. 10 shows a cross-sectional view through the wipes container 200, showing the stack of wipes 200 leaning against support structure 200. It will be apparent that the stack of wipes 212 in cylindrical container 200 leaning against support member 210 may assume a position that is closer to vertical than the stack of wipes 112 leaning against support member 110 of container 100. The actual orientation of the wipes may depend to a great extent on the specific shape and curvature of the top surface of the specific support member employed. Top surface 210*c* and structure 210 is shown as being steeper and taller than surface 110*c* and structure 110. With various differences aside, the features described above relative to container 100 are also present within container 200, e.g., the top surface 210*c* similarly provides an angle relative to bottom 202 that is from 120° to 150°. Due to differences in steepness, height, and curvature, the terminal angle (at 211*a*) relative to bottom 202 may be from about 120° to about 150°. Of course, embodiments where such angle is from 140° to 170°, similar to with support structure 100, are also possible. Any features described above relative to the rectangular shaped container 100 not specifically described with respect to the cylindrical shaped container 200 may of course be embodied therein.

As seen in FIG. 10, the height of support structure 210 may be as great, or even greater than the height of the bottom portion 200*a* of container 200. When positioned within interior cavity 208, support structure 210 may touch or nearly touch the rear sidewall (and top) of bottom portion 200*a*, depending on the particular dimensions of the components. By way of example, the bottom portion 200*a* may have a height of about 145 mm (e.g., 135 to 155 mm). It may have a tapered diameter, as shown. For example, at or adjacent bottom 202, the diameter (at its widest) may be about 110 mm (e.g., about 80 to about 125 mm). From its widest diameter adjacent bottom 202, the diameter may taper to a narrower diameter at its top, e.g., about 90 mm (e.g., 80-100 mm).

Figure 11:
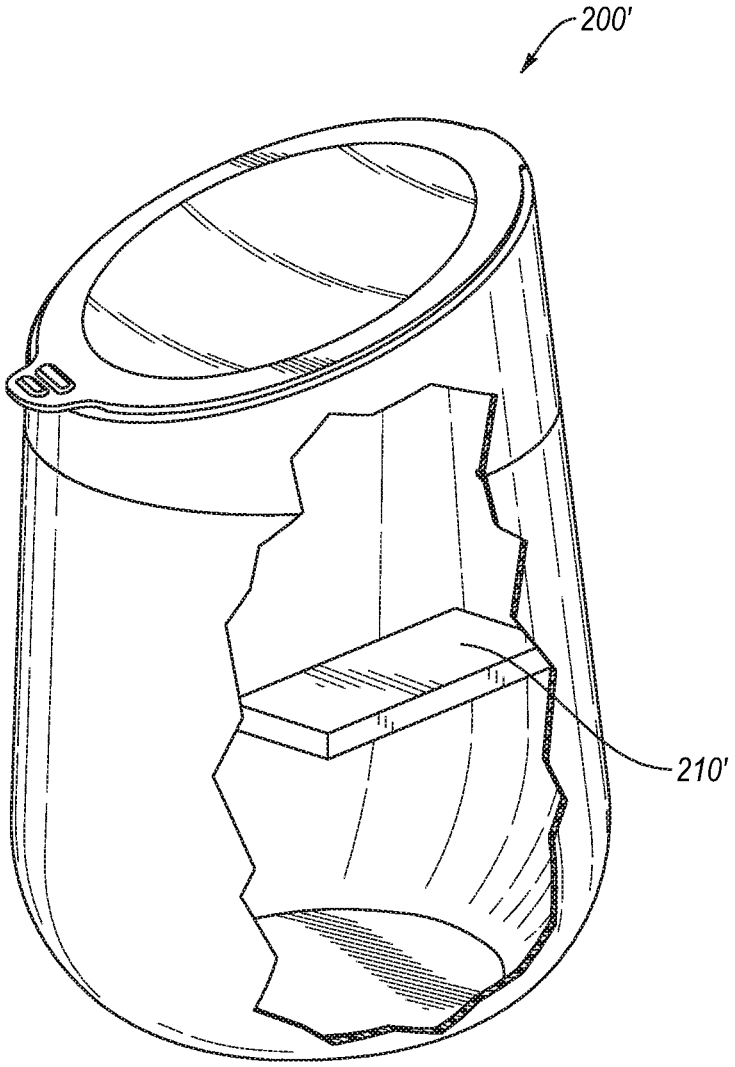
FIG. 11 shows an alternative container similar to that of FIG. 7, but in which the support structure is attached to the sidewall of the container.

Upper portion 200*b* may be relatively short, having a diameter equal to that at the top of the bottom portion 200*a*. The top 204 of the container 200 may be sloped, or angled, as described relative to top 104 of container 100. For example, the lid 204*b* and top 204 may form an angle from about 120° to about 150° relative to bottom wall 202. As a result, the height of portion 200*b* adjacent the front (where lid 204*b* may latch) may be about 25 to about 30 mm in height, while the height of portion 200*b* at the rear (e.g., where lid 204*b* may be hinged) may be about 55 mm (e.g., about 50 to about 60 mm) in height. With upper portion 200*b* coupled over lower portion 200*a* as seen in FIGS. 9-10, wipes 212 may be conveniently oriented for dispensing out of orifice 214. FIG. 11 illustrates an alternative support structure 210' attached to the sidewall 206 of container 200. Additional drawings and description of exemplary cylindrical containers can be found in U.S. Design patent application Ser. No. 29/519,387, filed Mar. 4, 2015, herein incorporated by reference in its entirety.

Figure 12A:
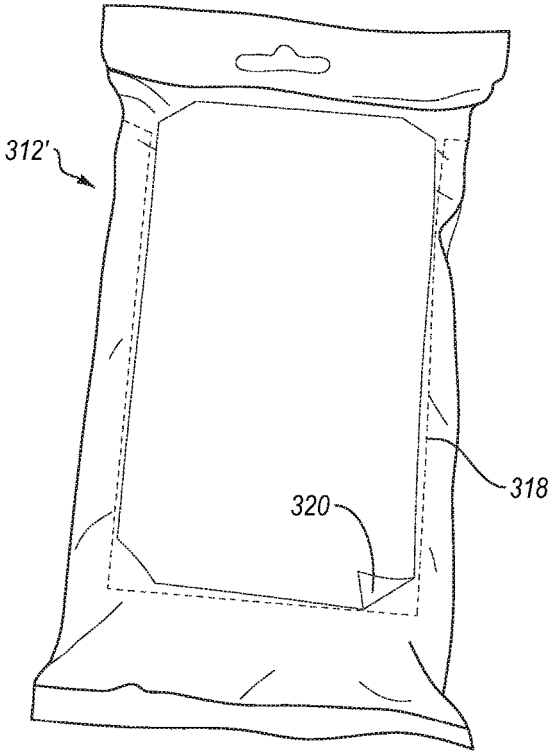
FIG. 12A is a perspective view of a rectangular stack of wipes, packaged within an air-tight flexible bag that includes a perforated or other tear away portion along a front face thereof, allowing a face of the stack of wipes to be exposed by removing the tear away portion, so that the stack of wipes (with or without the flexible bag backing) to be inserted into any of the containers described herein.
Figure 12B:
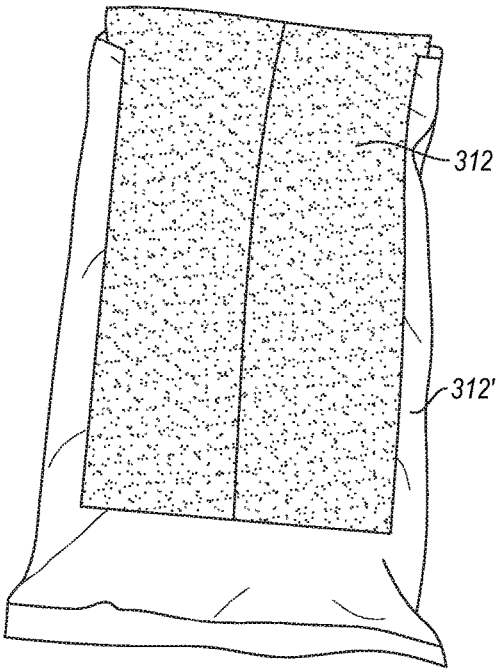
FIG. 12B is a perspective view of the stack of wipes of FIG. 12A, where the tear away portion of the flexible bag has been removed in preparation for loading the stack of wipes into any of the containers described herein.

Any configuration of rectangular stack of wipes may be employed with the described containers. FIGS. 12A-12B illustrate an exemplary package, that may be provided sealed within a flexible bag 312'. Such a bag may include a tear away portion 318, e.g., bounded by perforations, die-cutting, scoring, or other structure that causes the tear away portion 318 to be removable, e.g., upon pulling tab 320. Various other configurations for removing a portion of flexible bag 312', preferably without requiring the consumer to touch the wetted wipes 312 may be provided. FIG. 12B shows flexible bag 312' with wipes 312 exposed on just the top face of bag 312' once tear away panel 318 has been removed. The bag 312' holding stack of wipes 312 may be inserted as is into any of the containers described above. The portions of flexible bag 312' remaining in FIG. 12B may act as a barrier, to slow evaporation from the wipes, and to also allow the consumer to position the stack 312 into the container, without actually touching the wetted wipes, or at least minimizing such touching. Of course, the flexible bag 312' could also be fully removed, and the stack of wipes 312 could be inserted into the container as well, depending on consumer preference.

The stack of wipes may be prewetted with any desired cleaning or other composition. For example, such a composition may include water, and any desired functional ingredients. For example, one or more surfactants may often be included. Various other components may be included, as desired. For example, an organic or mineral acid (e.g., to aid in cleaning) may be included. One or more of a chelating agent, an oxidizing agent (e.g., any peroxide, such as hydrogen peroxide), or a hypochlorite, (e.g., sodium hypochlorite), or one or more other adjuncts selected from the group consisting of fragrances, dyes, preservatives, humectants, solvents, polymers, pH adjusters, solubilizers, and combinations thereof may also be provided. A quaternary ammonium compound for disinfection may be included. Exemplary amounts of some optional components may include less than 5%, less than 4%, less than 3%, less than 2% (e.g., from 1% to 2%, or from greater than 0.5% to about 1.5%) of an acid; less than 3%, less than 2%, less than 1% (e.g., from about 0.5% to 1%) of a pH adjuster (e.g., a hydroxide); less than 1%, less than 0.5%, less than 0.3% (e.g., from about 0.01% to 0.5%) of a solubilizer (e.g., to solubilize a fragrance or other oil); less than 1%, or less than 0.5% of dye, fragrance, and/or preservative; or less than 10%, less than 5%, less than 4%, less than 3%, less than 2%, less than 1%, or less than 0.5% of any other optional adjuvant. The majority of the composition may comprise water or another solvent (e.g., alcohols). Any suitable surfactants may be employed, including nonionic, anionic, cationic, ampholytic, amphoteric, zwitterionic surfactants, and mixtures thereof. Examples include, but are not limited to sulfates, sulfonates, betaines, alkyl polysaccharides, (e.g., alkyl polyglycosides ("APG"), also known as alkyl polyglucosides), alcohol ethoxylates, and combinations thereof. One or more of the selected surfactants may provide foam building characteristics.

By way of example, amine oxide chains may be provided with the one or more surfactants. For example, the surfactant(s) may include from 30% to 100% amine oxide components. Exemplary amine oxide chain lengths may include $C_8$ to $C_{16}$, e.g., $C_{12}$ and $C_{14}$. Sodium laurel sulfate (SLS) and sodium lauryl ether sulfate (SLES) are examples of suitable sulfate based amine oxide surfactants. APG chain length may be from $C_8$ to $C_{16}$, such as $C_8$ to $C_{14}$. Such chain lengths provide a good balance between hydrophobicity and hydrophilicity, creating a composition that can generate foam easily with minimal water, and which can also continue to generate foam under relatively high water conditions (e.g., as occurs when cleaning with rinse water). Various suitable APG surfactants are available from BASF under the tradename GLUCOPON (e.g., GLUCOPON 600). Various suitable SLS and SLES surfactants are available from STEPAN under the tradenames STEPANOL (e.g., STEPANOL WA EXTRA) and STEOL (e.g., STEOL CS 230). Various other surfactants available from these and other surfactant suppliers may be suitable for use.

A typical listing of anionic, ampholytic, and zwitterionic classes, and species of these surfactants, is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

A cleaning composition pre-dosed on the wipes may be effective at cleaning and removing soils and spills typically present on countertops, tabletops, and other hard surfaces. Some cleaning compositions could be formulated for safe use on hands, or other skin surfaces, as will be appreciated by those of skill in the art. While a pre-dosed stack of wipes including a cleaning or other liquid composition held thereon and/or therein may be preferred, it will be appreciated that the containers may also be used to dispense wipes from a stack where the wipes are dry, or at least dry to the touch. For example, a dry-to-the-touch wipe may feel generally dry, and may be intended to be wetted with water prior to use. Some fraction of water may already be included in a dry to the touch wipe. Such a dry to the touch wipe may be pre-dosed with a desired cleaning or other composition that becomes "activated" upon addition of additional water.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A dispensing container comprising:

(a) a container including a bottom, a top, and one or more side walls defining an interior cavity;

(b) a fixed support structure in the interior cavity which is adjacent to the bottom of the container, and the support structure has a side surface that is straight and perpendicular to the bottom of the container and a top surface which is curved along its entire length from a front bottom edge to a top rear edge wherein an initial angle $\theta_1$ formed between the top surface and the bottom of the container is greater than 90°, an angle $\theta_2$, formed by a first tangent line contacting a middle portion of the top surface and the bottom of the container is from 120° to 150°, and an angle $\theta_3$, formed by a second tangent line contacting the top terminating edge of the top surface and to a point extending out alongside the bottom of the container is 140° to 170°;

(c) a rectangular stack of wipes having two short sides and two long sides, wherein the rectangular stack of wipes is positioned in the interior cavity in contact with the support structure so that a first short side of the stack of wipes contacts the bottom of the container and a second short side of the stack of wipes is adjacent to the top of the container; and (d) an orifice in the top of the container where the orifice and the top are angled downward and are parallel with one another and at least a central portion of the stack of wipes is parallel with the top.

2. The container of claim 1 wherein the top of the container forms an angle that is from 120° to 150° relative to the bottom.

3. The container of claim 2 wherein a substantial length of the stack of wipes is within a 20° of a plane defined by the top.

4. The container of claim 1 wherein a top surface of the support structure is a convexly curved surface.

5. The container of claim 1 wherein the support structure does not touch the one or more side walls.

6. The container of claim 5 wherein the support structure has a side surface that is vertical relative to the bottom of the container.

7. The container of claim 6 wherein the top of the container is angled downward towards a front of the container.

8. The container of claim 6 wherein the support structure has a wedge shape.

9. The container of claim 1 wherein the container is rectangular in cross-sectional shape.

10. A dispensing container comprising:

(a) a container including a bottom, a top, and one or more side walls defining an interior cavity;

(b) a fixed support structure in the interior cavity which is adjacent to the bottom of the container, wherein the support structure has a bottom surface and side surface which are straight and perpendicular to one another and a top surface that is convexly curved along its entire length wherein an initial angle $\theta_1$ formed between the top surface and the bottom of the container is greater than 90°, an angle $\theta_2$, formed by a first tangent line contacting a middle portion of the top surface and the bottom of the container is from 120° to 150°, and an angle $\theta_3$, formed by a second tangent line contacting the top terminating edge of the top surface and to a point extending out alongside the bottom of the container is 140° to 170°;

(c) a rectangular stack of wipes having a short side and a long side, wherein the rectangular stack of wipes is positioned in the interior cavity so that only one short side of the stack contacts the bottom of the container and a long side of the stack to lean against the top surface of the support structure; and (d) an orifice in the top of the container where the orifice and the top are angled downward and are parallel with one another.

11. The container of claim 10 wherein the top of the container forms an angle that s from 120° to about 150° relative to the bottom.

12. The container of claim 10 wherein a short side of the rectangular stack of wipes is positioned inside the container adjacent to the top of the container.

13. The container of claim 10 wherein the container is rectangular in cross-sectional shape.

14. The container of claim 13 wherein the dispensing orifice forms an angle that is from 120° to about 150° relative to the bottom.

15. The container of claim 10 wherein the top of the container is angled downward towards a front of the container.

* * * * *